United States Patent [19]

Albers et al.

[11] Patent Number: 5,040,262

[45] Date of Patent: Aug. 20, 1991

[54] SOOT-REMOVAL BLOWER

[75] Inventors: Karl Albers, Isselburg, Fed. Rep. of Germany; Hans Schwade, Atlanta, Ga.

[73] Assignee: Bergemann, Wesel, Fed. Rep. of Germany

[21] Appl. No.: 502,548

[22] Filed: Mar. 30, 1990

[30] Foreign Application Priority Data

Apr. 1, 1989 [DE] Fed. Rep. of Germany ..... 3910616

[51] Int. Cl.[5] ..... F23J 3/00

[52] U.S. Cl. ..... 15/316; 15/317

[58] Field of Search ..... 15/316.1, 317, 318, 15/318.1

[56] References Cited

U.S. PATENT DOCUMENTS

| | | | |
|---|---|---|---|
| 1,012,533 | 12/1911 | Erlewine | 15/316.1 |
| 1,709,065 | 4/1929 | Dwyer, Jr. | 15/316.1 |
| 3,752,170 | 8/1973 | Murbach | 15/316.1 X |
| 4,276,856 | 7/1981 | Dent et al. | 15/316.1 X |
| 4,635,314 | 1/1987 | Peckman et al. | 15/316.1 X |
| 4,813,384 | 3/1989 | Zalewski | 15/316.1 X |
| 4,905,900 | 3/1990 | Scharton et al. | 15/316.1 X |

FOREIGN PATENT DOCUMENTS

| | | | |
|---|---|---|---|
| 2307311 | 8/1973 | Fed. Rep. of Germany | 15/316.1 |

*Primary Examiner*—Paul T. Sewell
*Assistant Examiner*—Ted Kavanaugh
*Attorney, Agent, or Firm*—Max Fogiel

[57] ABSTRACT

A soot-removal blower comprising , first, a lance (1) with nozzles (2) at the tip and with its base connected by way of a valve (9) to a supply of fluid and, second, a choke in path of the fluid. The choke is inside the lance in the vicinity of the nozzles.

6 Claims, 3 Drawing Sheets

SOOT-REMOVAL BLOWER

BACKGROUND OF THE INVENTION

Soot-removal blowers are employed to blast soot off heat-emitting surfaces in boilers and heat exchangers for example. They are charged with a fluid, air or steam for instance, at an elevated pressure that is reduced in their nozzles to the level prevailing in the heat exchanger. The jets leaving the nozzles accordingly have enough kinetic energy to remove undesirable deposits from the inner surface of the heat exchanger.

The cleaning efficiency of a soot-removal blower depends on the size of the nozzles and from the level of pressure at which the gaseous fluid flows into them. More fluid per unit of time can flow through a nozzle and more soot can be dislodged when the fluid is more highly compressed and when the nozzle has a longer diameter.

Although the pressure in the intake line is generally substantially higher, 40 to 60 bars for example, the fluid usually enters the nozzles at a pressure of 3 to 20 bars. In known soot-removal blowers the pressure is reduced to the level needed for cleaning by a variable choke disk accommodated in a valve. From the valve the fluid flows to the nozzles through such other design-dictated components as a core and a lance. To ensure that the soot-removal blower will clean as effectively as possible, as much fluid as possible must flow to the nozzles. In this context, however, the high flow rates that occur in the sections downstream of the soot-removal blower are detrimental in that they lead to severe pressure losses and to more noise. Once permissible noise levels are exceeded, expensive noise-insulation cladding is necessary or the level of fluid per blower must be decreased, meaning that more blowers must be added to the boiler or heat exchanger. Either approach substantially increases the cost of the cleaning system.

SUMMARY OF THE INVENTION

The object of the invention is to improve the generic soot-removal blower to the extent that either the permissible rate of fluid flow can be increased without increasing pressure loss or noise or the pressure loss and noise can be decreased without decreasing the rate of flow.

The invention exploits the principle that a particular volume of fluid will flow more slowly through a hollow body of constant cross-section because of the lower specific volume. The specific volume of many gases is approximately inversely proportional to pressure. If for example, a gas is flowing through a pipeline at a rate of 200 m/sec at a pressure of 10 bars, it will drop at 20 bars to on the order of 100 m/sec. If accordingly the fluid in a soot-removal blower is supplied as close as possible to the nozzles at high pressure, the rate of flow will drop accordingly and/or more can flow through. Since the pressure losses in a system depend essentially on the rate of flow, the loss in the essential components of the blower can be decreased by intentionally displacing the site of pressure reduction to the vicinity of the nozzles.

Lower flow rates often make it unnecessary to sound-insulate the section that drives the soot-removal blower. Another useful result is that the choke, which is often a source of noise itself, can be shifted in accordance with the invention to inside the boiler or heat exchanger, whence the exterior insulation already in place will prevent almost all noise from escaping without additional sound insulation around the soot-removal blower.

BRIEF DESCRIPTION OF THE DRAWINGS

One embodiment of the invention will now be described in detail with reference to the drawing, wherein.

DESCRIPTION OF THE PREFERRED EMBODIMENTS

Figure 1:
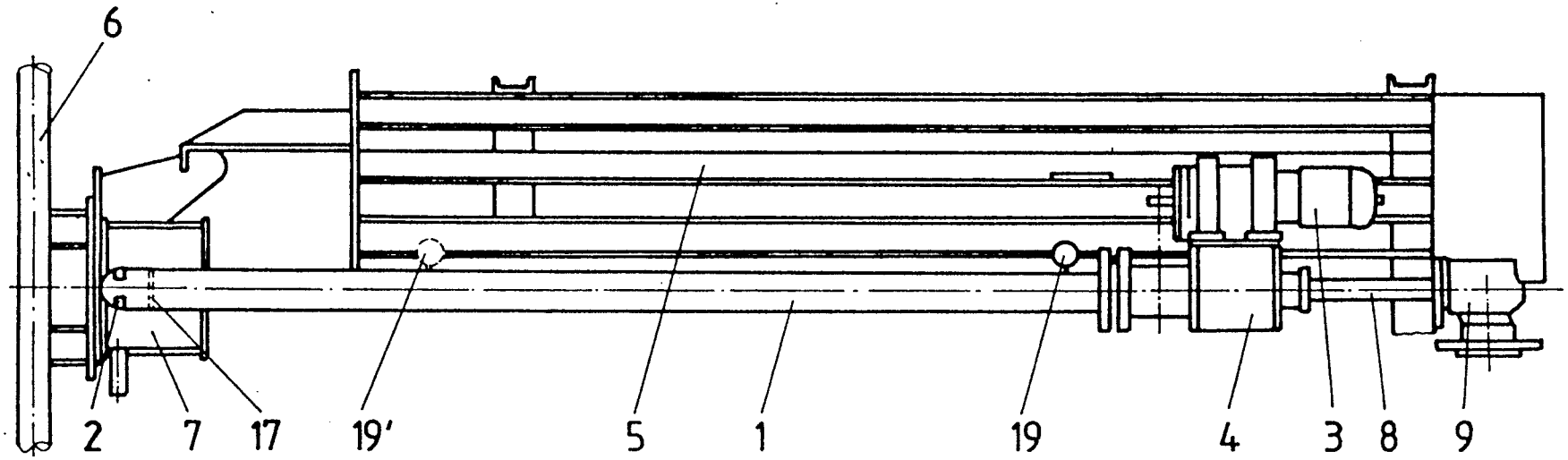
FIG. 1 is a side view of a soot-removal blower.
Figure 2:
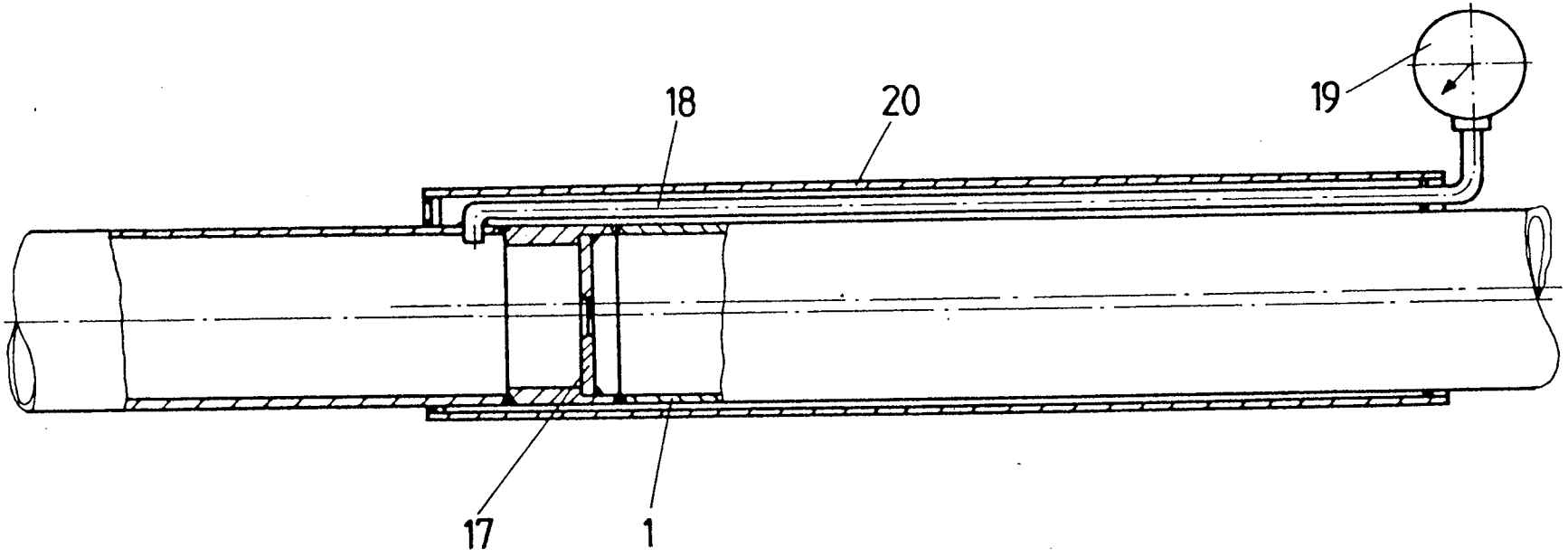
FIG. 2 is a larger-scale longitudinal section through part of the blower.

The illustrated soot-removal blower has a lance 1 with nozzles 2 at the tip. Lance 1 is attached to a transmission carriage 4 that is driven by a motor 3 and travels back and forth along with the lance on a stationary track 5. Motor 3 can also rotate lance 1, in which event nozzles 2 will execute a helical motion. The travel of lance 1 is limited by a stationary switch at each end.

Lance 1 can be introduced through a hole into a heat exchanger or boiler, the wall of which is represented by a wall pipe 6. The opening is surrounded by a box 7 that seals it off from the atmosphere. Nozzles 2 are inside the box when the lance is in its rest position.

The sliding lance 1 surrounds a stationary core 8, the rear end of which has a connection for a blasting fluid—steam or air for example. The amount of fluid is controlled by a valve 9 mounted on the blower.

Figure 3:
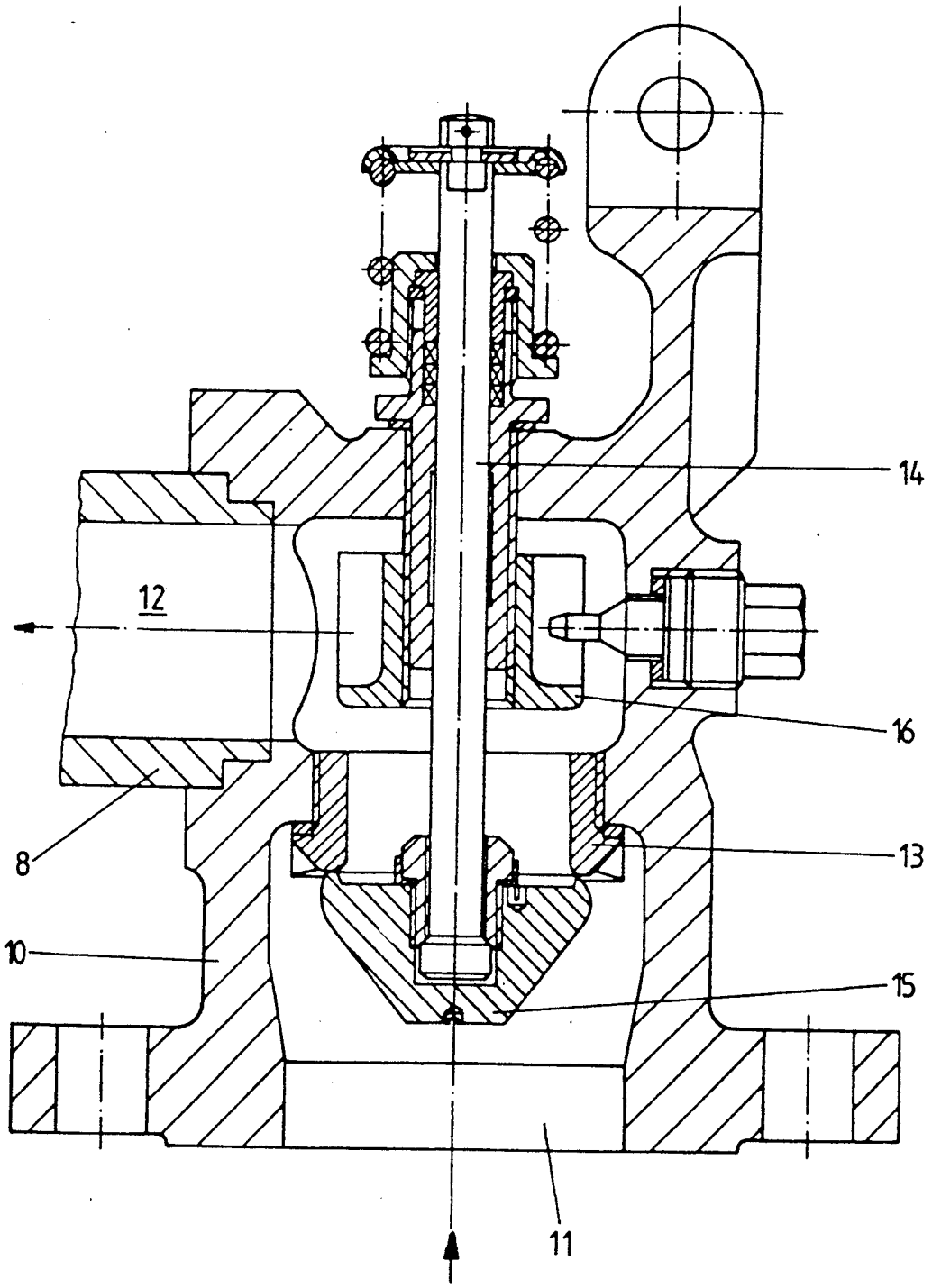
FIG. 3 is a longitudinal section through a blower valve.

The in-itself known valve 9 illustrated in FIG. 3 consists of a housing 10, an intake 11, an outlet 12, and a valve seat 13. A valve spindle 14 can be adjusted axially inside housing 10 and has a blocking cone 15 at the bottom that operates in conjunction with valve seat 13. A choke disk 16 that can be secured in various positions is mounted on spindle 14 downstream of valve seat 13. The purpose of the choke disk 16 in conventional soot-removal blowers is to reduce the pressure of the fluid entering valve 9 to the level desired upstream of nozzles 2. The disk is exploited in conjunction with the system now to be described, however, to fine-adjust the pressure.

Inside lance 1 and in the vicinity of nozzles 2 is a choke. When the soot-removal blower is in operation, the section of the lance 1 that accommodates nozzles 2 and the choke is inside the heat exchanger. The choke consists preferably of a diaphragm 17 that is welded tight into lance 1. The fluid flows through lance 1 at total entry pressure, and the pressure is not reduced to the desired level until just before it enters the nozzles.

A pressure gauge is temporarily or permanently connected to the soot-removal blower to control the pressure of the fluid downstream of diaphragm 17. A test line 18 opens for this purpose into lance 1 downstream of diaphragm 17 and extends into a manometer 19. The test line 18 in a root-removal blower with a lance 1 that does not rotate is mounted on the outside of the lance. Lance 1 and test line 18 are surrounded by a jacket 20, making it possible to seal off the opening in the wall of the heat exchanger. Manometer 19 is secured to lance 1 at a point that allows it to remain outside the heat exchanger and read off even when the soot-removal blower is in operation with the lance far inside as illustrated in FIG. 1.

Soot-removal blowers can be employed to clean out denox catalyzers. The fluid is steam at a temperature of 320° C. and a pressure of 18 bars. The pressure upstream of nozzles 2 should be 2 bars and the steam should flow at a rate of 1.6 kg/sec. Table 1 lists the results obtainable with a soot-removal blower at the state of the art, wherein the pressure is reduced in the valve and with a blower in accordance with the invention, wherein the pressure is reduced just upstream of nozzles 2. It will be evident that the design in accordance with the invention decelerates the flow of fluid in core 8 from 380 to 60 m/sec and the noise level from 120 to 75 dB (A).

TABLE 1

| | Prior art | Invention |
|---|---|---|
| Soot-removal valve | | |
| Pressure upstream of valve, bars | 18 | 18 |
| Pressure loss in valve, bars | 0.7 | 0.7 |
| Pressure loss in choke disk, bars | 14.1 | none |
| Flow rate in choke disk | supersonic | none |
| Core | | |
| Pressure at intake, bars | 3.2 | 17.3 |
| Pressure loss, bars | 0.7 | 0.1 |
| Pressure loss, bars/min | 0.17 | 0.027 |
| Maximum flow rate, m/sec | 380 | 60 |
| Lance | | |
| Pressure at intake, bars | 2.5 | 17.2 |
| Pressure loss, bars | 0.5 | 0.07 |
| Pressure loss, bars/min | 0.06 | 0.008 |
| Maximum flow rate, m/sec | 300 | 40 |
| Nozzles | | |
| Pressure loss at diaphragm, bars | none | 15.1 |
| Pressure upstream of nozzles, bars | 2 | 2 |
| Flow rate of steam, kg/sec | 1.6 | 1.6 |
| Noise level, dB (A) | 120 | 75 |
| [diagram] State of the art | | |
| [diagram] Invention | | |

We claim:

1. A soot-removal blower for cleaning heating surfaces in heat exchangers, comprising: a housing, a source of gaseous medium, means on said housing and connected to said source for conducting in a gaseous medium under pressure; nozzle means for expanding said gaseous medium in the ambient pressure in a heat exchanger, said nozzle means having exit means emitting blowing streams with high kinetic energy directed at the heating surfaces of said heat exchanger for removing undesired deposits on said heating surfaces, said gaseous medium being conducted in by said conducting means under a pressure which is higher than the pressure of said blowing streams exiting from said nozzle means for holding cross-sections of said conducting means substantially small, pressure of said gaseous medium being reduced substantially directly in the neighborhood of said nozzle means for decreasing pressure losses and noise formation; said nozzle means comprising a lance having a tip with nozzles and having a base; valve means connected between said base and said source; and throttle means in path of said gaseous medium in said lance and in vicinity of said nozzles.

2. A soot-removal blower as defined in claim 1, wherein said throttle means has an orifice plate.

3. A soot-removal blower as defined in claim 1, including a testing line communicating with said lance downstream of said throttle means; and manometer means connected to said testing line.

4. A soot-removal blower as defined in claim 3, including jacket means surrounding said testing line and said lance.

5. A soot-removal blower as defined in claim 1, wherein said valve means has pressure-establishing means.

6. A soot-removal blower for cleaning heating surfaces in heat exchangers, comprising: a housing; a source of gaseous medium; means on said housing and connected to said source for conducting in a gaseous medium under pressure; nozzle means for expanding said gaseous medium in the ambient pressure in a heat exchanger, said nozzle means having exit means emitting blowing streams with high kinetic energy directed at the heating surfaces of said heat exchanger for removing undesired deposits on said heating surfaces, said gaseous medium being conducted in by said conducting means under a pressure which is higher than the pressure of said blowing streams exiting from said nozzle means for holding cross-sections of said conducting means substantially small, pressure of said gaseous medium being reduced substantially directly in the neighborhood of said nozzle means for decreasing pressure losses and noise formation; said nozzle means comprising a lance having a tip with nozzles and having a base; valve means connected between said base and said source; and throttle means in path of said gaseous medium in said lance and in vicinity of said nozzles; said throttle means having an orifice plate; a testing line communicating with said lance downstream of said throttle means; manometer means connected to said testing line; jacket means surrounding said testing line and said lance; and pressure-establishing means in said valve means.

* * * * *